United States Patent [19]

Tissari

[11] Patent Number: 4,799,368

[45] Date of Patent: Jan. 24, 1989

[54] DEVICE FOR WASHING OF CARPETS

[76] Inventor: Osmo Tissari, Laaksopolku 1, SF-70910 Vuorela, Siilinjärvi, Finland

[21] Appl. No.: 902,450

[22] PCT Filed: Dec. 10, 1985

[86] PCT No.: PCT/FI85/00099

§ 371 Date: Aug. 8, 1986

§ 102(e) Date: Aug. 8, 1986

[87] PCT Pub. No.: WO86/03525

PCT Pub. Date: Jun. 19, 1986

[30] Foreign Application Priority Data

Dec. 10, 1984 [FI] Finland ..... 844858

[51] Int. Cl.[4] ..... D06B 1/02; D06B 15/02; D06B 15/09; D06B 23/04

[52] U.S. Cl. ..... 68/19.1; 68/22 B; 68/62; 68/205 R

[58] Field of Search ..... 68/205 R, 22 R, 19.1, 68/62; 134/64 R

[56] References Cited

U.S. PATENT DOCUMENTS

| | | | |
|---|---|---|---|
| 2,729,536 | 1/1956 | Pull et al. | 8/149.3 |
| 2,787,153 | 4/1957 | Ketchum et al. | 68/205 R |
| 2,986,149 | 4/1958 | Brakel | 134/64 R |
| 3,253,432 | 5/1966 | Moore et al. | 68/205 R X |
| 3,473,884 | 10/1969 | Politzer et al. | 68/205 R X |
| 3,491,778 | 1/1970 | Lehnert et al. | 134/64 R |
| 3,643,474 | 2/1972 | Schiffer | 68/22 R X |
| 3,717,015 | 2/1973 | Spencer | 68/205 R X |
| 4,095,443 | 6/1978 | Hasselschwert | 68/22 R |

*Primary Examiner*—Philip R. Coe

*Attorney, Agent, or Firm*—Cushman, Darby & Cushman

[57] ABSTRACT

The washing of carpets, to which belong a comparatively stiff bottom structure and a fibre layer fixed to the bottom layer, is troublesome and laborious. The object for the invention is a device for washing of carpets, to which device belong rolls, supported on which the carpet is arranged to be conveyed within the device, to which rolls belong the supporting roll (2) for supporting of the carpet during the washing and a rinsing roll (4), placed at a distance from the supporting roll, for supporting of the carpet during rinsing. To the device belongs a between the supporting roll and the rinsing roll placed washing and rinsing apparatus (6), which is arranged to flush under pressure being detergent on the surface of the carpet located on the supporting roll and scavenging agent on the surface of the carpet located on the rinsing roll.

6 Claims, 3 Drawing Sheets

DEVICE FOR WASHING OF CARPETS

The object of the invention is a device for washing of carpets, in particular fibre carpets, to which device belong rolls, supported on which the carpet is arranged to be conveyed within the device, to which rolls belong a supporting roll to support the carpet during the washing process and a rinsing roll, located at a distance from the supporting roll, to support the carpet during the rinsing process.

To the carpets made of artificial and natural fibres belong a relatively stiff bottom layer made of rubber or corresponding material and a fibre layer fixed to the bottom layer. These carpets cannot be washed in normal washing machines due to their stiff bottom structure. The problem is the washing of the big carpets efficiently and at low costs. Nowadays the carpets are generally washed by hand using auxiliary equipment, whereby the costs are high. Washing contrivances have been developed, in which the carpets are cleaned through conveying them supported on rolls e.g. in different kinds of washing basins and by brushing them during the process in order to remove the dirt. The brushing, however, wears and tears to a great extent the carpets and the time of usage for them is shortened. With the help of the present washing devices the carpets cannot be washed efficiently.

The aim of the invention is to bring forth a washing device, which eliminates the disadvantages in the present washing contrivances for carpets. In particular the aim with the invention is to bring forward a device for the washing of carpets, by means of which the carpets made of artificial and natural fibres can be washed efficiently and at low costs. The aim of the invention is additionally to bring forth a device for washing of the carpets, which is easy to use and dependable in operation.

The aim of the invention is reached by means of the device, which mainly is characterized in that, what is presented in claims.

In the device according to the invention between the supporting roll and the rinsing roll a washing and rinsing apparatus is placed, which is arranged to flush under pressure being liquid detergent on the surface of the carpet located on the supporting roll and liquid scavenging agent on the surface of the carpet located on the rinsing roll. Hereby the carpet is washed efficiently, because the detergent and the scavenging agent can be flushed on the surface of the carpet at a high pressure, favourably at a pressure of 100 kp/cm$^2$, whereby an efficient cleaning action is reached. The device is simple and efficient and the pressure of the detergent and scavenging agent flushes can be regulated to conform with the dirtness and the quality of the carpet. The washing and the rinsing apparatus being located close to the supporting and rinsing rolls the jets are pointed at the carpet conveyed between the rolls. The carpet is in a bent position, whereby the gaps between the fibres are opened and a good cleaning effect is achieved. In addition comes, that the device in accordance with the invention is simple to manufacture and to operate.

In the following the invention is explained in detail by referring to the attached drawings, which illustrate a device in one application of the invention.

Figure 1:
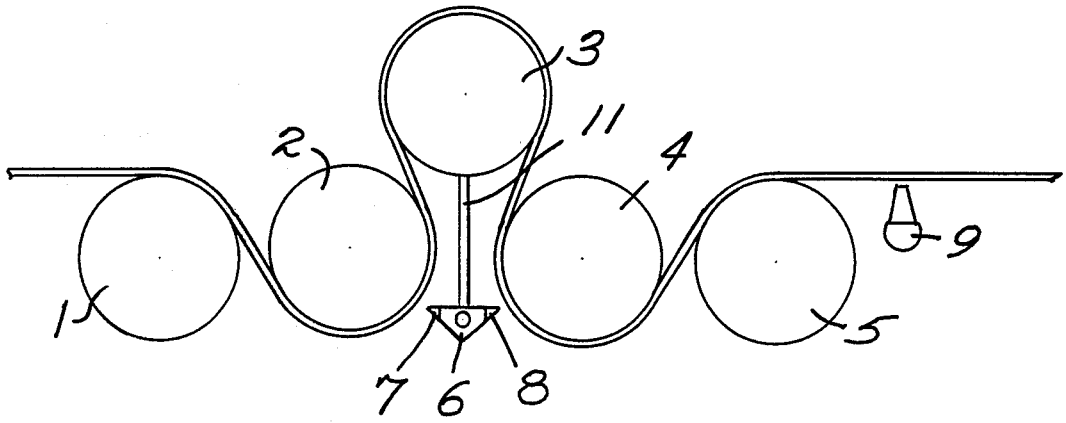
FIG. 1 is a schematic side elevational view, partly in crosssection and partly broken away for clarity, illustrating a device for washing carpets formed in accordance with the present invention.

To the application illustrated in the drawings belongs a feeding roll 1 placed in the front part of the device for the purpose of feeding the carpet into the device, a next to the feeding roll placed supporting roll 2 to support the carpet during the washing, and at a distance from the supporting roll placed turning roll 3, and at a distance from the turning roll and close to the supporting roll placed rinsing roll 4 to support the carpet during the rinsing and the next to the rinsing roll movable placed drying roll 5 for drying of the carpet. The rolls are preferably mounted within an apparatus as shown for example in FIG. 2. The carpet is fed into the device with the side to be washed downwards and is directed by adjustable guiding supports (not visible in FIG. 1) from the feeding roll to the supporting roll and from there over the turning roll to the rinsing roll, from where the carpet is directed trough the drying roll out of the device (see FIGS. 1 and 3). In the application presented the feeding roll, the supporting roll, the rinsing roll and the drying roll are located mainly in the same line at a short distance from the adjacent rolls. The turning roll is placed at a distance from the supporting roll and the rinsing roll outside the line formed by the rolls. The rolls can of course in other applications be placed in some other way, whereby e.g. the distances between the rolls may vary.

To the device illustrated on the drawing belongs a washing and rinsing apparatus 6 placed between the supporting roll and the rinsing roll. To the washing and rinsing apparatus belongs in the presented application the body 6, which is arranged movable in the cross direction in regard of the rolls and the carpet. To the apparatus belongs the partition wall 11 placed between the supporting roll and the rinsing roll and the body 6 is arranged to be movable supported on the partition wall resting on the support made in the lower part of the partition wall. The washing and rinsing apparatus is moved back and forth in the cross direction and the motion direction of the apparatus is changed at the turning points, which are adjustable according to the width of the carpet, in a known way by means to different width tracers.

Figure 4:
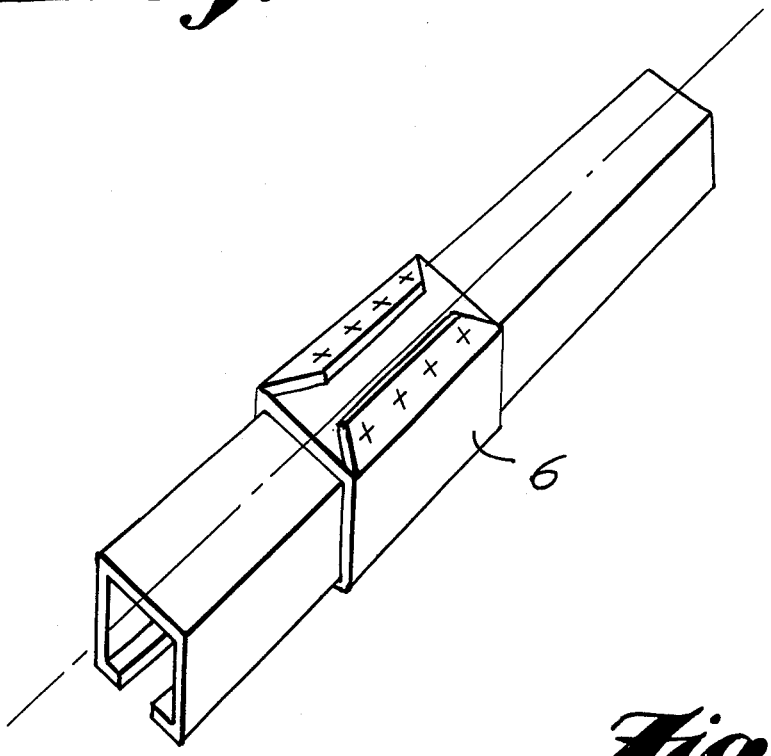
FIG. 4 is a perspective schematic view, partly broken away for clarity of a tubular contrivance having several jets formed in accordance with the present invention.
Figure 5:
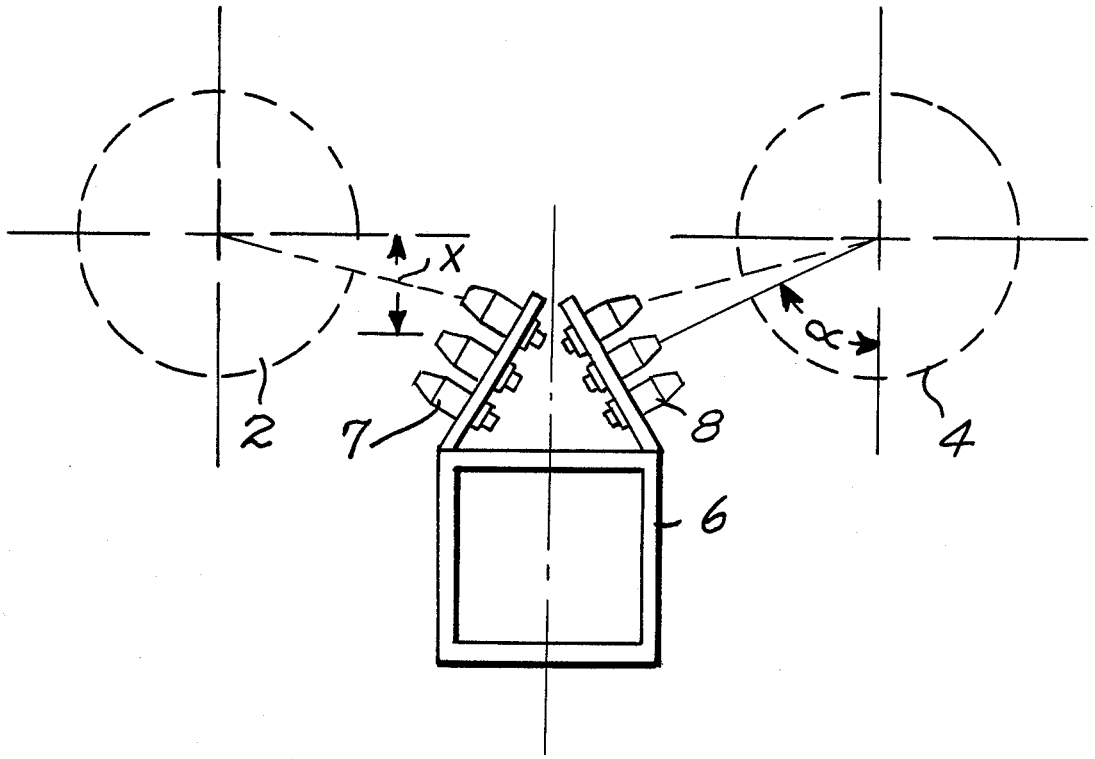
FIG. 5 is a schematic side elevational view, partly in crosssection, illustrating the washing and rinsing apparatus in relation to the supporting roll and rinsing roll of the present invention.

As can be seen in FIGS. 4 and 5, for example, jets 7 and 8 are located on both sides of the the washing and rinsing apparatus and pointed at the supporting roll and the rinsing roll. To the apparatus hoses are led, by means which from the jets 7 the detergent on the surface of the carpet to be cleaned and from the jets 8 the scavening agent on the surface of the carpet is flushed. The pressure of the jet flush is steplessly adjustable and the pressure being over 100 kp/cm$^2$ the carpet is cleaned efficiently.

Figure 3:
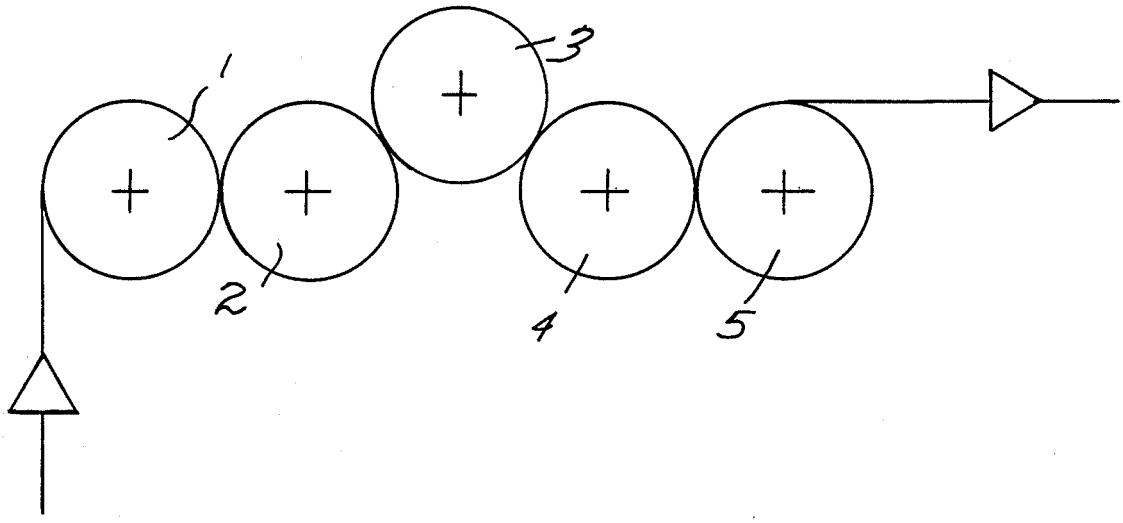
FIG. 3 is a schematic side elevational view showing the placement of rolls in accordance with the present invention and the direction of feed of the carpet therethrough.
Figure 2:
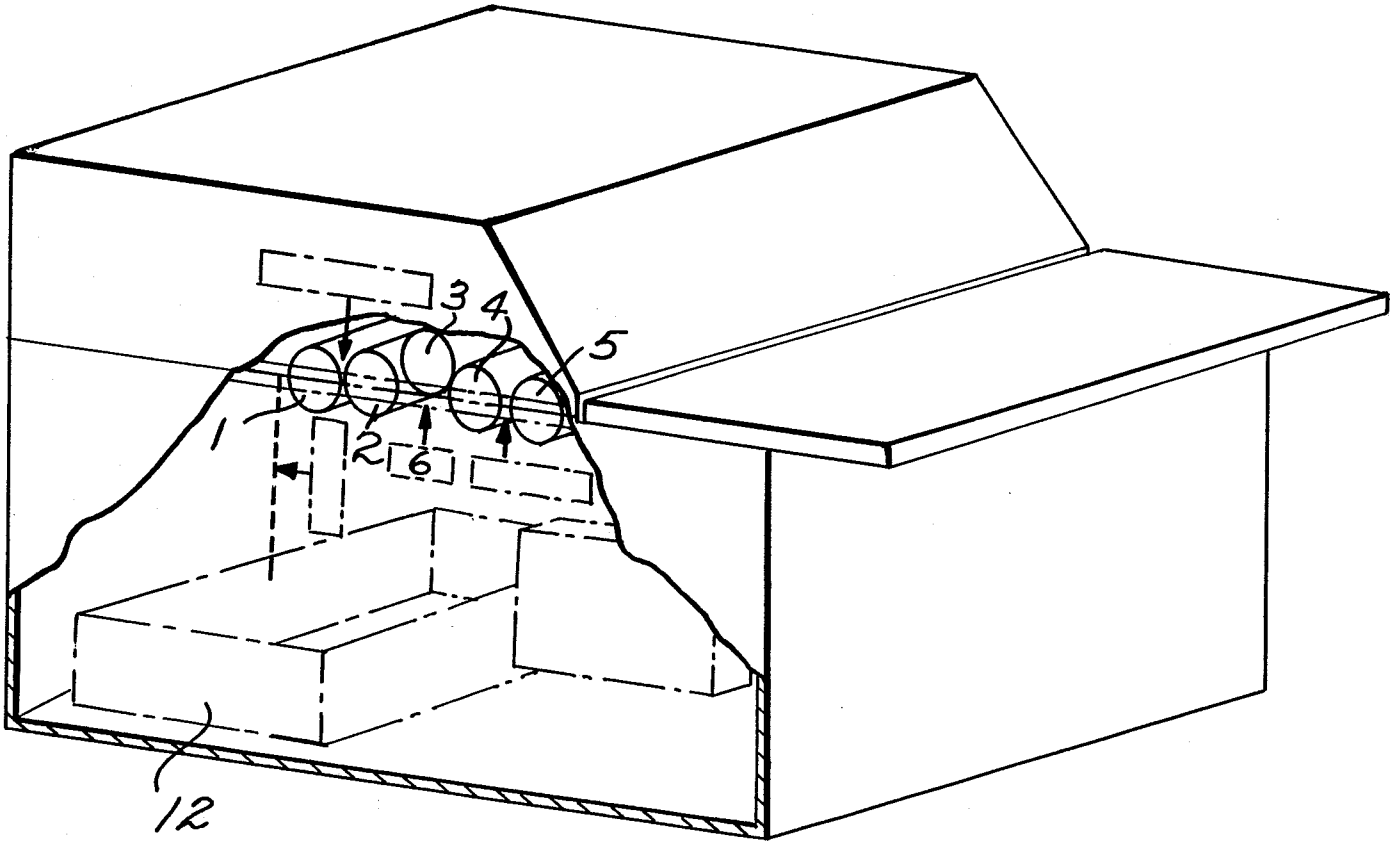
FIG. 2 is a schematic perspective view illustrating a device for washing carpets formed in accordance with the present invention mounted in a carpet washing apparatus.

When feeding the dirty carpet into the device the carpet is washed by means of the washing jets in a bent position supported by the supporting roll, whereby the raising tracks between the fibres ar opened and the carpet is efficiently cleaned (see FIGS. 1 and 3 and 5 in particular). With the help of the turning roll the carpet is turned in such a way, that at the rinsing roll the fibre surface of the carpet is in the direction to the rinsing jets. The scavening agent flushed from the rinsing jets is washing the detergent efficiently away.

To the device belongs further a drying contrivance 9 placed close to the drying roll for drying of the carpet coming from the rolls. The drying contrivance can be compressed air operated or e.g. a suction drier. The drying contrivance makes the action of the drying roll more efficient and it is not necessary from the point of view of the operation of the device.

In a second application to the device in accordance with the invention belongs a detergent basin 12 located near the feeding roll, whereat the carpet to be cleaned is arranged to be transferred through the detergent basin prior to the supporting roll. Particularly when washing very dirty carpets this kind of pre-washing and soaking is nesessary.

The form and function of the washing and rinsing apparatus can vary in other applications of the invention. The washing and rinsing apparatus is in an application of the invention arranged to extend tubeformed (FIGS. 4 and 5) in the cross direction of the carpet for the width of the carpet and the rolls, for example along element 13. In this case to the apparatus belong several, at a distance from each other placed jets on both sides of the body. In this application as well as in the earlier presented applications the washing and rinsing apparatus is located between the supporting roll and the rinsing roll mainly at an equally long distance from the rolls.

In one application of the invention the jet or the jets are arranged in a known way revolving in regard of their axes, whereby an equal dispersion of the liquid is achieved and as a consequence of this a more uniform washing result.

The invention is not limited to the presented applications, but it can vary within the range of the claims.

I claim:

1. An apparatus for washing carpets, particularly carpets having a nap on one side thereof, having a conveyance path along which carpets to be cleaned are conveyed, said apparatus comprising:

a supporting roll mounted along said conveyance path and having a longitudinal axis disposed transverse to a longitudinal axis of said conveyance path for supporting a carpet to be cleaned during a washing process of the apparatus;

a rinsing roll mounted along said conveyance path, downstream of said supporting roll, having a longitudinal axis disposed transverse to the longitudinal axis of said conveyance path, for supporting a carpet during a rinsing process of said apparatus;

a turning roll mounted intermediate said supporting roll and said rinsing roll, along said conveyance path, and spaced from a plane defined through said longitudinal axes of said supporting roll and said rinsing roll; and a washing and rinsing apparatus mounted so as to be disposed intermediate and adjacent to said supporting roll and said rinsing roll, said washing and rinsing apparatus including means for conveying a washing fluid at high pressure to and directing said washing fluid toward said supporting roll and means for conveying a rinsing fluid at high pressure to and directing said rinsing fluid towards said rinsing roll, whereby a carpet conveyed along said conveyance path is disposed in a convex configuration on said supporting roll and in a convex position on said rinsing roll and whereby fluids conveyed and directed by said washing and rinsing apparatus are impinged upon said convex portions of said carpet.

2. An apparatus as in claim 1, wherein said washing and rinsing apparatus is a tubular element mounted so as to have a longitudinal axis extending in parallel to said longitudinal axes of said supporting roll and said rinsing roll so as to be transverse to a longitudinal conveying direction of said carpet, and a plurality of jet means for directing said fluids toward said convex carpet portions, the jets for washing fluid and the jets for rinsing fluid being spaced from one another on either said of said tube.

3. An apparatus as in claim 1, wherein said washing and rinsing apparatus is mounted so as to be reciprocally movable in a direction transverse to said longitudinal axis of said conveyance path and has at least one jet for flushing liquid detergent and at least one jet for flushing liquid scavenging agent under a pressure of at least 100 kp/cm$^2$ on the convex surfaces of the carpet.

4. An apparatus as in claim 1, further comprising a drying roll mounted adjacent to and downstream of said rinsing roll a space between said rinsing roll and said drying roll being less than a thickness of a carpet conveyed therebetween whereby the carpet is pressed between said rinsing roll and said drying roll to thereby remove fluid therefrom.

5. An apparatus as in claim 4, further including a drying device mounted adjacent to and downstream of said drying roll for drying carpet conveyed from said drying roll.

6. An apparatus as in claim 1, further including a detergent basin disposed upstream of said supporting roll along said conveyance path of said carpet whereby carpet is conveyed through said detergent basin prior to conveyance to said supporting roll for prewashing.

* * * * *